US009522405B2

(12) United States Patent
Stehli, Jr. et al.

(10) Patent No.: US 9,522,405 B2
(45) **Date of Patent: *Dec. 20, 2016**

(54) FLUID DISPENSER, SYSTEM AND FILLING PROCESS

(71) Applicants: Charles J. Stehli, Jr., Maple Glen, PA (US); Donald J. Pansier, Green Bay, WI (US); Robert B. DeMatteis, Grass Valley, CA (US)

(72) Inventors: Charles J. Stehli, Jr., Maple Glen, PA (US); Donald J. Pansier, Green Bay, WI (US); Robert B. DeMatteis, Grass Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/628,588

(22) Filed: Feb. 23, 2015

(65) Prior Publication Data

US 2015/0165460 A1 Jun. 18, 2015

Related U.S. Application Data

(62) Division of application No. 13/476,210, filed on May 21, 2012, now Pat. No. 8,960,502.

(Continued)

(51) Int. Cl.
*B67B 7/00* (2006.01)
*B05B 11/04* (2006.01)

(Continued)

(52) U.S. Cl.
CPC ..... *B05B 11/047* (2013.01); *B65B 3/022* (2013.01); *B65B 3/04* (2013.01); *B65B 3/045* (2013.01);

(Continued)

(58) Field of Classification Search
CPC ... B05B 11/0043; B05B 11/0045; A61J 9/001; A61J 9/005; A61J 11/002; B65D 83/0055; B65D 47/2018; B65D 47/2031; B65D 47/205; B65D 47/2056; B65D 47/2062; B65D 47/2068; B65D 47/2075; B65D 47/2081; B65D 47/2087

(Continued)

(56) References Cited

U.S. PATENT DOCUMENTS 289,528 A * 12/1883 Goodner ..... A61M 3/0262 239/327
2,110,928 A * 3/1938 De Buys ..... A61J 9/001 215/11.3

(Continued)

OTHER PUBLICATIONS

Flange_Definition of Flange by Merriam-Webster.*

*Primary Examiner* — Patrick M Buechner
*Assistant Examiner* — Randall Gruby
(74) *Attorney, Agent, or Firm* — Advantage IP Law Firm

(57) ABSTRACT

Systems, methods, and processes are disclosed for the manufacture, filling and dispensing of flowable contents. The dispenser system generally includes a dispenser bottle, a dispensing cap, a pre-filled container, and an optional inversion tube wherein the pre-filled container contains flowable contents therein for dispensing when a dispenser bottle is squeezed, pumped or sprayed. A user grasps the bottle, squeezes it to increase internal pressure, and forces out through the dispensing cap the flowable contents. Upon release, the system allows air to enter and replace the forced-out flowable contents and neutralize the pressure in the space between the container and the bottle. An inline process of manufacturing and filling the containers is provided.

11 Claims, 9 Drawing Sheets

Related U.S. Application Data

(60) Provisional application No. 61/520,573, filed on Jun. 8, 2011, provisional application No. 61/572,609, filed on Jul. 18, 2011, provisional application No. 61/574,392, filed on Aug. 1, 2011.

(51) Int. Cl.

| | |
|---|---|
| ***B65D 83/00*** | (2006.01) |
| ***B65D 47/20*** | (2006.01) |
| ***B65D 51/24*** | (2006.01) |
| ***B65B 47/04*** | (2006.01) |
| ***B65B 3/02*** | (2006.01) |
| ***B65B 3/04*** | (2006.01) |
| ***B65B 7/16*** | (2006.01) |
| ***B65B 7/28*** | (2006.01) |
| ***B65B 47/02*** | (2006.01) |

(52) U.S. Cl.
CPC ..... *B65B 7/164* (2013.01); *B65B 7/2842* (2013.01); *B65B 47/02* (2013.01); *B65B 47/04* (2013.01); *B65D 47/2031* (2013.01); *B65D 51/249* (2013.01); *B65D 83/0055* (2013.01); *B65B 2220/16* (2013.01)

(58) Field of Classification Search
USPC ..... 222/184, 95, 105, 490, 491, 494,222/206–215, 386.5; 239/323–328
See application file for complete search history.

(56) References Cited

U.S. PATENT DOCUMENTS 2,281,651 A * 5/1942 Wolcott ..... A47G 19/183 222/173
2,497,198 A * 2/1950 Adda ..... A61J 9/005 215/11.1
2,608,320 A * 8/1952 Harrison, Jr. ..... B65D 83/0055 222/107
2,624,485 A * 1/1953 Boston ..... A61J 9/001 215/11.3
2,793,778 A * 5/1957 Maxwell ..... A61J 9/001 215/11.1
2,804,995 A * 9/1957 Fee ..... B65D 83/0055 215/12.1
2,961,849 A * 11/1960 Hitchcock ..... F25C 1/24 215/12.1
3,070,265 A * 12/1962 Everett ..... B65D 83/62 222/386.5
3,140,802 A * 7/1964 Everett ..... B65D 83/62 222/184
3,206,054 A * 9/1965 Militello ..... A61J 9/001 137/533.17
3,249,262 A * 5/1966 Barr ..... B05B 7/206 222/215
3,275,193 A * 9/1966 Barr ..... B65D 83/62 222/386.5
3,406,853 A * 10/1968 McLeod ..... A61J 9/001 215/11.3
3,487,989 A * 1/1970 Ignell ..... B65D 15/02 156/227
3,592,365 A * 7/1971 Schwartzman .... B65D 83/0055 222/209
3,620,420 A * 11/1971 Normos ..... B65D 83/62 222/386.5
3,770,154 A * 11/1973 Johnson ..... A61J 9/04 215/11.3
3,776,408 A * 12/1973 Wald ..... A61J 9/001 215/11.3
3,834,570 A * 9/1974 Barr ..... A61J 9/04 206/390
4,089,443 A * 5/1978 Zrinyi ..... B65D 83/62 222/386.5
4,469,250 A * 9/1984 Evezich ..... B65D 83/0055 222/83.5
5,005,733 A * 4/1991 Stoody ..... A61J 9/001 215/11.3
5,271,534 A * 12/1993 Fillmore ..... B05B 11/0043 222/380
5,303,852 A * 4/1994 Yamawaki ..... B65D 83/0055 222/209
5,344,045 A * 9/1994 Richter ..... B65D 1/0215 215/12.2
5,416,303 A * 5/1995 Grooms ..... B29C 65/18 156/274.2
5,454,486 A * 10/1995 Mack ..... B05B 11/047 222/105
5,667,107 A * 9/1997 Lindsey ..... B65D 35/56 222/173
5,747,083 A * 5/1998 Raymond ..... A61J 11/002 215/11.3
6,042,850 A * 3/2000 Ida ..... A61J 9/001 215/11.1
6,253,936 B1 * 7/2001 Kong ..... A61J 9/001 215/11.1
6,857,561 B2 * 2/2005 Williams ..... B65D 3/22 220/359.3
6,920,991 B2 * 7/2005 Holley, Jr. ..... A61J 9/001 206/219
6,945,428 B2 * 9/2005 Shimizu ..... B65D 83/0055 222/105
7,303,086 B2 * 12/2007 Nhan ..... A61J 9/001 215/11.1
7,506,754 B2 * 3/2009 Segovia, Jr. ..... A61J 1/2093 206/219
7,546,930 B2 * 6/2009 Banik ..... B65D 83/0805 206/233
7,641,078 B2 * 1/2010 Boumnso ..... B65D 83/0055 222/105
8,118,183 B2 * 2/2012 Iwahashi ..... A61F 9/0008 215/12.2
2005/0029285 A1 * 2/2005 Gay, III ..... G01F 11/082 222/1
2006/0226171 A1 * 10/2006 Sternberg ..... B65D 83/0055 222/95
2010/0001020 A1 * 1/2010 Ashley ..... B65D 83/38 222/95
2010/0108717 A1 * 5/2010 Szymanski ..... B65D 35/34 222/100
2011/0259915 A1 * 10/2011 Rice ..... B65D 83/62 222/95

* cited by examiner

FLUID DISPENSER, SYSTEM AND FILLING PROCESS

CROSS-REFERENCE TO OTHER APPLICATIONS

This application is a divisional application of U.S. application Ser. No. 13/476,210, filed on May 21, 2012, now U.S. Pat. No. 8,960,502, entitled the same and claiming the benefits of U.S. Provisional Patent Application No. 61/574,392, filed on Aug. 1, 2011, U.S. Provisional Patent Application No. 61/572,609, filed on Jul. 18, 2011, and U.S. Provisional Patent Application No. 61/520,573, filed on Jun. 8, 2011, all are which are hereby incorporated by reference in their entireties.

BACKGROUND

1. Field of the Invention

The preferred embodiment relates generally to bottle dispensers such as those used to dispense fluids and sauces, and more specifically it relates to a dispenser and system that is efficacious for use in higher volume applications, such as restaurants or certain industrial uses, and is also adaptable to medium- and high-volume filling operations.

2. Background

Squeeze bottle dispensers are commonly used to dispense sauces such as mustard, ketchup, dressings, and the like. One of the most common sauce dispensers is one in which most consumers are very familiar, the common squeezable, plastic mustard bottle, such as the one used by French's® mustard. Its use is easy to understand and easy to use by simply removing the cap, turning it upside down, squeezing the plastic bottle and dispensing the sauce from a pointed tip in the cap. After use it is stored in the refrigerator in an upright position. One of the primary problems associated with the use of this traditional plastic squeeze bottle is wastage, as it is difficult to extract the last remaining contents. It is an inconvenience when trying to dispense the remaining contents from the squeeze bottle as users have to turn the bottle upside down and shake it several times in order to extract the remaining sauce. The squeeze bottle dispenser is unlike that of a toothpaste tube, which can be flattened to squeeze out the last remaining toothpaste. Another problem with this type of bottle is that it is not easy to refill and is instead thrown away, contributing substantially to the waste stream.

Dispensers used in restaurants and higher volume fast food chains have partially addressed the problems associated with the ordinary plastic squeeze bottle. One of the more popular brands is Tablecraft®. These restaurant bottles tend to be larger, cylindrical and more recently, some are dispensed and stored in an inverted disposition. The inverted bottles are able to dispense liquid sauces by using specialty valves that are more or less, leak-resistant. In other words, the sauce will dispense when the bottle is squeezed, but the sauce does not leak out when the squeezing pressure is released and when the bottle is stored in an inverted disposition. The primary benefits of the inverted bottle to restaurants is that users can quickly grasp and dispense sauces without turning the bottle upside down, and perhaps more important, the contents are always ready for dispensing since they will settle in the bottom of the bottle, where the special leak-resistant dispensing valve is located. Examples of this type of dispenser is the FIFO® bottom dispensing bottle and the more recently the single-use bottle used by H.J. Heinz® for its ketchup, which is sold in the supermarket retail trade. Another benefit of a bottom dispensing bottle for the fast food trade is that it can be refilled, helping to reduce the trash stream compared to single-use bottles. However, the uses of these dispensers have created new problems, most importantly ones associated with sanitation, productivity and waste.

While it may be advantageous to refill the inverted bottle, as is the case in most high-volume fast food restaurants, the bottle must be washed out thoroughly in between uses to prevent the build up of bacteria and contamination. Likewise, the large bulk containers create new environmental concerns since they also contribute to the trash stream and if the contents are not properly stored and handled, they can become contaminated as well. Washing and refilling the inverted bottles is a time consuming, and at times tedious task, when attempting to remove all of the caked-on sauces that may accumulate on the bottle and in the valve.

Various attempts have been made over the years to produce a dispenser that can evacuate all the contents, beginning with U.S. Pat. No. 2,608,320 Harrison. His invention provides a pump type of dispenser that employs an air pressure system for ejecting a material (substance) inside renewal cartridges that has a movable member bonded to a rigid member. Its intended use was for products such as shaving cream and toothpaste. Methods to manufacture this type of cartridge today would be cost prohibitive, let alone in 1953.

Another attempt is illustrated in U.S. Pat. No. 5,305,920 Reiboldt, et. al. In the '920 patent, it utilizes a relatively complex support tube (sometimes called a birdcage) that is attached to a lid component, inserted inside a bag filled with fluid contents, and which lid/birdcage is secured to a squeezable bottle. Typically the lid serves as a dispensing fitment, such as may be used for toothpaste or other viscous materials. The approach has merit as it may use reusable bags for its contents, however, cleaning the birdcage/lid/fitment combination presents a challenging proposition if it were to be used in a high volume application, plus the cost of the combination unit would be costly based on today's standards. In the present day high-volume sauce dispensing industry it would be inconceivable such an expensive, difficult to wash dispenser would be used. It is more suitable for single-use retail applications.

In U.S. Pat. No. 6,305,577, Fillmore uses a narrow necked pouch and hanger to accomplish a similar result for viscous fluids. The '577 invention uses a rather sophisticated [rigid] hanger/pouch assembly with a flexible bag (to be filled with viscous contents) bonded to the hanger. The result is substantially the same as the '920 or '320 patent in that an inversion of the flexible bag will take place. Like the '920 and '320 patents, its cost and limitation of use is also restricted to low-volume or single-use, retail applications.

Mueller in U.S. Pat. No. 6,364,163 accomplishes essentially the same outcome as well but uses a rod and piston to guide a plunger which dispenses the fluid contained in the bag. Yawagaki in U.S. Pat. No. 5,303,852 also accomplishes a similar objective with the use of an internal bag, one that is thermally welded to a mounting sleeve. Like all of the previously described patents, however, both of these dispensers are costly, and the bag designs with its fitments, or thermal welds, are too costly for high-volume use.

Other than the inverted dispensing bottle, all of the prior art inventions are impractical for high-volume use in restaurants and in particular, fast food chains. The expense of the dispensers and the various hangers, birdcage/cap assemblies, pistons and so on, are prohibitive for high-volume, low cost, restaurant chains. The use of rigid support members also make their use difficult, if not impractical for squeeze bottle applications since the rigid support members are located in the ideal spot in which users want to squeeze, the lower middle portion of the bottle. The cleaning of the various elements and components is difficult, reuse is cumbersome at best, and the cost for the complex bag configurations is too high for high volume use. In addition, the combination of many internal components and a seamed bag creates additional areas where product residue becomes trapped and creates unnecessary waste. While the use of the inverted refillable dispenser may be desirable in restaurants, serious questions have been raised regarding the critical need to thoroughly wash the dispensers between uses to prevent bacteria and contamination, the productivity problems associated with washing and refilling, and the questionable environmental qualities of the bulk containers.

The use of a low-cost dispenser and sauce refill system that can overcome the numerous problems associated with prior art would be valuable to the restaurant trade and many others. Not one of the prior art products or patents is suitable for, or can be adapted or modified to accomplish, the dispensing of fluids and liquids as desired by the preferred embodiment. This coupled with an efficacious method of pre-filling an internal liner and likewise reduce waste would be highly desirable for high-volume, high productivity uses, such as restaurants and the like.

SUMMARY

Systems and methods are disclosed for dispensing a sauce with a dispenser system with an elongated dispenser bottle, a bottom dispensing cap, an inversion tube having a squeezable mid-section; and a pre-filled liner adapted to be inserted into the dispenser bottle, wherein the pre-filled liner includes viscous materials therein for delivery when the inversion tube is squeezed on or below the squeezable mid-section. During use, the user can grasp the bottle on or below a bottle mid-section; squeeze the bottle to increase internal pressure in the bottle and forcing sauce out of the bottle; and upon release, the system allows air to enter and replace the forced-out sauce and neutralizes the pressure in a space between the liner and an interior of the bottle.

The dispenser, liner, and system of the preferred embodiment overcomes the problems associated with prior art. It also provides the added benefit of being able to be cost-effectively filled using present day production processes, which is not possible with prior art. Also of importance is that the preferred embodiment overcomes the need to wash and refill the dispensers and eliminates the sanitation problems associated with storing open bulk containers of sauces and fluids. The preferred embodiment is the only invertible liner (or cartridge as it may appear when filled and lidded) that can be effectively squeezed at the most desirable location, the lower middle portion of the bottle, as it uses a unique internal inversion tube that provides the desired rigidity and yet flexibility. Other major advantages of the preferred embodiment are that it substantially reduces waste, its use is intuitive to any restaurant employee, and requires virtually no training. These advantages alone can save a restaurant chain hundreds of thousands, even millions, of dollars a year. The simplicity of the design of the preferred embodiment includes a low cost dispenser squeezable bottle (preferably of the inverted style), a liner and an inner inversion tube. All of its components are exceptionally low cost in comparison to prior art. All components may be made with the most cost-effective, state of the art means used in industry today, thus the cost is far lower. Obviously the cost of a pre-filled liner/inversion tube cartridge of the preferred embodiment is substantially less than the cost of a pre-filled squeeze bottle, which also represents a substantial savings to restaurants. The cost of the liner/inversion tube of the preferred embodiment compared to all the prior art patents is from 30% to 80% less.

The unique tapered design of the liner and the inversion tube are perfectly matched, which maximizes evacuation of the contents, reduces waste and improves productivity. The taper is optimized for nesting which aids in the shipping and handling process during filling. Unlike prior art, there is no need to bond or attach the inversion tube to the liner, or the dispenser, as the inversion tube fits snugly inside the liner so they function as a single unit. Since the inversion tube is not affixed to the dispenser and is disposable, no cleaning is required. The nesting of the tapered inversion tubes provides easy extraction and insertion during the filling process. The inversion tube and liner of the preferred embodiment may be manufactured as two separate components or as one single molded piece as will be illustrated. In either case the dispensing is essentially the same. During filling, however, the insertion step is eliminated with the one-piece component. A single step may also be used if the liner may also be shipped with the inversion tube inserted inside.

The tapered liner used in the preferred embodiment may be formed using a deep-draw thermoform operation and has no seams. Upon dispensing, it provides a smooth, effortless inversion inside the inversion tube, and being seamless, it conforms to the inner contour of the inversion tube without forming pockets, cavities or crevices where sauces or fluids may collect, thus the contents are evacuated with minimal waste. The unique deep-draw thermoform process used to make the liner is relatively new, but the filling with fluids and sauces may be performed on traditional filling lines.

Unlike prior art, the thermoformed liners can also be made with food-related barrier properties to increase shelf life, yet still remain soft and flexible enough to invert properly so that waste is minimized.

Also unlike other prior art products the raw material composition and design of the inversion tube is such that it is rigid enough to support inversion of the liner, yet flexible enough to be squeezed in its lower region, where the inversion tube is located. This is important because the natural location (sweet spot) for most users to grasp a squeeze bottle and start squeezing is in the mid- to lower-section. This would be difficult, if not impossible with prior art.

Furthermore, unlike the complicated prior art systems with their components, fitments, welds and so on, the pre-filled liners in the system of the preferred embodiment can be easily, quickly loaded into the bottle dispenser. The liner's flange naturally seats itself in the dispenser bottle and requires no bonding or other attachment to it as required with certain prior art. The user simply inserts the liner/inversion tube into the dispenser bottle, screws on the cap, and starts squeezing.

The squeeze bottle used in the preferred embodiment is also unlike the prior art systems in that it is a simple design with few components and its use is similar to the standard squeeze bottles currently used at home and in industry. The bottle only requires one opening on one end, unlike the complicated systems requiring top and bottom access and/or caps.

The valves in the dispenser of the preferred embodiment prevent leakage and reduce waste and likewise prevent air, gases and bacteria from entering the product. It may be stored in any environment suitable to maintain proper sanitation for the type of fluid contained.

Since the liners of the preferred embodiment are prefilled, the common problem of the contents coming into contact and leaching on to the interior of a squeeze bottle is eliminated, thus preventing cross contamination from a previously used bottle dispenser. This also prevents discoloration of the squeeze bottle since there is no contact with the contents. This substantially increases the life of the squeeze bottle, which may in turn be used for different types of sauces without being tainted by discoloration. Then again, once the sauce has been completely used, instead of tediously washing the dispenser bottle after use, a new pre-filled liner is slipped into place instead.

The disposable liners of the preferred embodiment completely eliminate the unsanitary task of trans-filling and funneling products from large bulk sauce bags or cans into the traditional squeeze bottle. Its use likewise completely eliminates the common problem of "topping off" when filling prior art squeeze bottles, which may harbor bacteria in the residue in the bottle from prior use. Topping off is a big problem in the restaurant trade as the residue and fugitive particles from prior use frequently remain in the bottom of the squeeze bottle leaving a breeding ground for bacteria and an unsanitary environment.

The dispenser bottle of the preferred embodiment may use a combination of a one-way umbrella valve to allow air to enter the bottle but not escape, and a one-way duckbill valve which closes tightly after dispensing a fluid. Both prevent air or gases reaching the contents and maintain the interior of the bottle in a sanitary vacuum thus, preserving freshness and increasing shelf life. Unlike other prior art the filled dispenser bottle and liner/inversion tube system of the preferred embodiment can be used and stored both upside down or right side up, depending on the users preference.

Another substantial benefit of the preferred embodiment is that it is able to dispense a wide variety of products including thick viscous products, thin products, and even fluids that contain heavy particulates. If preferred a choice of a variety of duckbill valves can also be used with various slits and durometers to dispense various products. If needed, a dome valve or something similar may be used in combination with the duckbill valve to take pressure off of the head of the duckbill valve and prevent thin fluids, such as vinegar, from leaking when stored upside down for long periods.

Because the dispensing system is pressurized and holds the contents in a vacuum, the contents are always ready to be instantly dispensed with a gentle squeeze, regardless of whether the bottle has been stored right side up or upside down. Unlike the traditional squeeze bottles, this system never requires banging or shaking and never spits or burps. The pressurized system reduces waste and increases overall productivity and performance.

The preferred embodiment may also be used with a pump or spray bottle instead of a valve such as the duckbill or dome valve. The same pressurized technology will suspend the fluid contents in a vacuum and reduce waste and dispense with ease. With the spray application the dispenser bottle of the preferred embodiment is able to spray 360 degrees while holding it at any angle including upside down. Since the fluid being sprayed is always at the top it never spits or misfires. Likewise with a pump, it may swivel about the cap and pump its contents upside down or right side up.

The objectives of the preferred embodiment are to provide:

1) A low cost sauce dispenser;
2) A dispenser system that dispenses substantially all of its contents;
3) A dispenser that does not require refilling;
4) A cost effective liner and inversion tube inversion system;
5) A dispensing system that uses sanitary prefilled liners;
6) A pre-filled liner that inverts upon the application of pressure;
7) A pre-filled liner with an inversion tube that can be squeezed in it lower section.
8) A dispensing system that maintain the internal cleanliness and sanitation of the dispenser bottle;
9) An internal inversion tube that can be nested to reduce costs and effect better handling during the filling process;
10) A liner than can be nested to reduce costs and effect better handling during the filling process;
11) A method of using pre-filled liners that does not require training;
12) A dispensing system that may be used right side up or upside down without the contents settling;
13) A spray bottle dispenser system that evacuates substantially all of its contents;
14) A pump-style dispenser system that evacuates substantially all of its contents.
15) A process of pre-filling an invertible liner on an automated system.

Furthermore, it is an object of this application to illustrate the preferred embodiments and broadly state the methodologies that may be used in order to describe the primary objective being accomplished.

DETAILED DESCRIPTION OF THE INVENTION

A. Description of the Preferred Embodiment

Figure 1:
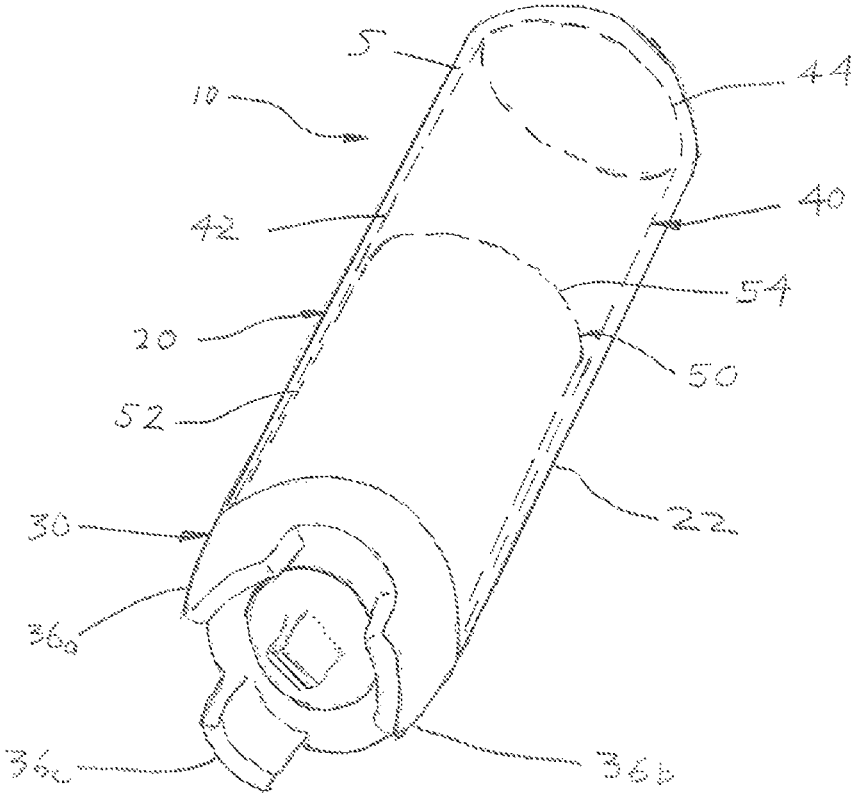
FIG. 1 is a perspective view of the preferred embodiment illustrating the components that make up one of the preferred versions.
Figure 2:
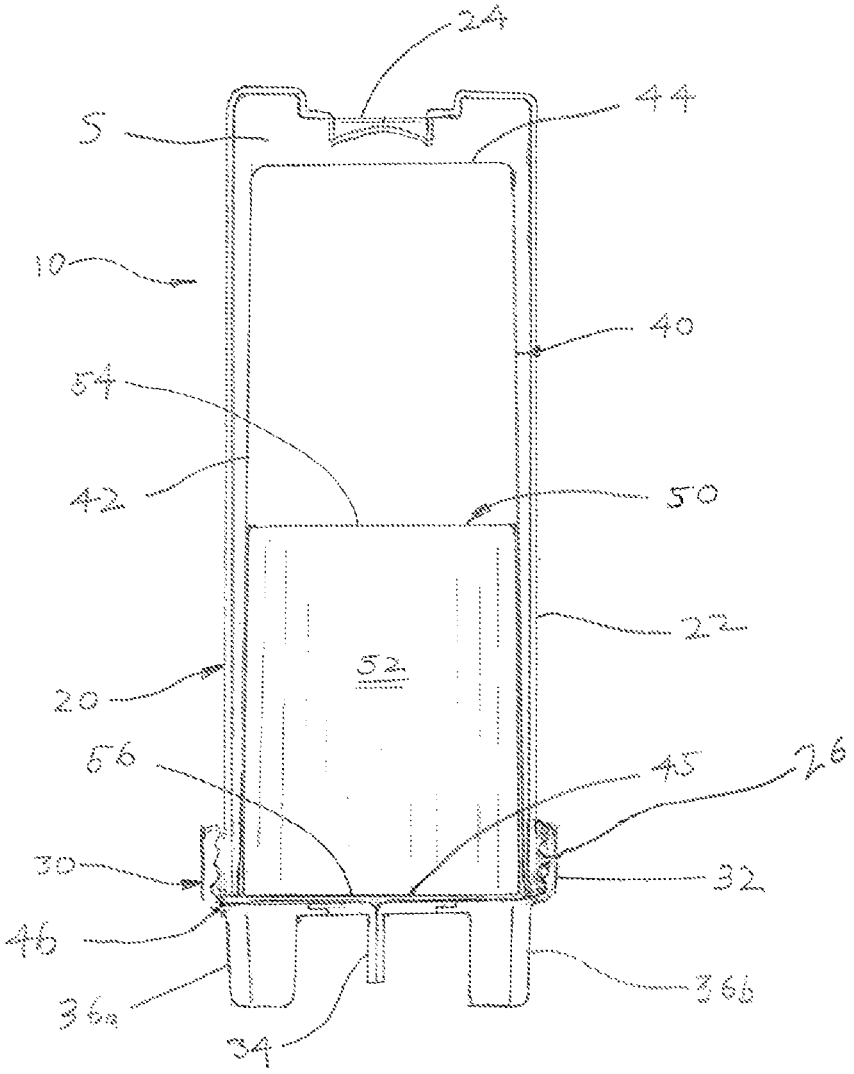
FIG. 2 is a cross-sectional view of the dispenser system illustrated in FIG. 1.

In FIGS. 1 and 2, the dispenser system of the preferred embodiment 10 consists of a dispenser bottle 20, a bottom dispensing cap 30, a pre-filled liner 40, and an inversion tube 50. Dispenser bottle 20 has a body 22, an umbrella valve 24, and a threaded open end 26 (see FIG. 2). Cap 30 has a screw-on ring 32, a duckbill valve 34, and three feet 36*a*, 36*b* and 36*c* (not shown on FIG. 2). Pre-filled liner 40 has a body 42, a closed end 44, an open end 45, a flange 46, and prior to insertion a sealed lid 60 (see FIG. 3). Inversion tube 50 has a body 52 an open top 54 and an open bottom end 56.

Bottle 20 of dispenser 10 is typically made of a squeezable material much like that of traditional squeeze bottles used today such as Heinz Ketchup or a Tablecraft bottle, model #124. It has a single open end 26, which receives cap 30. Tightening cap 30 onto bottle 20 securely seats liner 40 at its flange 46, which is tightly secured between bottle 20 and cap 30. Securing cartridges, inserts, and various items by the use of a flange is commonly known in many trades. The typical method is from the pressure of the tightened cap, however other combinations may also serve the same purpose, as, for example, a snap on cap, or a combination snap on and twist and turn a quarter arc style of cap. The importance here is that liner 40 (with its inversion tube 50 inside) is secured in place between bottle 20 and cap 30 and that air is not allowed to escape. This secure closure is what helps maintain the pressurized bottle of the preferred embodiment.

The one-way umbrella valve 24 at the end of bottle 20 serves two essential functions. First, after dispenser bottle 20 is squeezed and contents are dispensed, one-way umbrella valve 24 allows air to enter the bottle, thus neutralizing space S between liner 40 and the inside of bottle body 42, which in turn causes the contents inside liner 40 to remain, more or less in a vacuum state, (as shown in detail in FIG. 7*a*). Once the user stops squeezing the bottle, the internal pressure ceases and dispensing (or evacuation) of contents also ceases. Second, umbrella valve 24 also serves as a check valve and prevents outside contaminates from entering when dispenser 10 is being stored. The preferred embodiment is not limited to the use of an umbrella valve 24 as illustrated, as there are other forms of valves, such as a duckbill, butterfly, and so on, that may provide essentially the same results. The size of this valve may be determined based on the application, the size of the bottle, the amount of desired pressure to maintain internally and so on. The location may be in anywhere on the bottle, but ideally it is in a location that is not an obstruction for the user.

Cap 30 of the preferred embodiment is typically a molded plastic piece that has a centrally located, flexible dispensing valve, such as duckbill valve 34. Being a one-way valve, it allows for contents, fluids, sauces, and the like, to evacuate, in other words, to be dispensed from dispenser 10 when bottle 20 is squeezed and pressurized. The purpose of feet 36*a*, 36*b*, and 36*c* is so that a user may store dispenser 10 in an inverted (upside down) position for a more efficacious dispensing without allowing duckbill valve 34 to touch a counter top. As illustrated in FIG. 2, duckbill valve 34 is shorter than feet 36*a*, 36*b*, and 36*c*, thus would not touch the surface when stored.

As illustrated in FIGS. 1 and 2, liner 40, which has inversion tube 50 secured inside, has been inserted inside dispenser bottle 20 and retained in place by screw-on ring 32. It is ready to be dispensed either upside down or right side up as will be illustrated in FIGS. 7*a* and 7*b*. The simplicity of the design and structure make its use instinctive, exceptionally easy. In these illustrations, liner 40 and inversion tube 50 may also be one single unit as illustrated in FIG. 8. Regardless of the type of contents, fluid or sauce, the material used to construct liner 40 is typically a form of plastic material, a single layer, co-extruded film, or laminated film that may be modified in any number of configurations as required. As is understood in the trade, some types of materials may require certain barrier properties that others do not. For example, sauces such as ketchup will require barrier properties much different than ordinary water.

Figure 3:
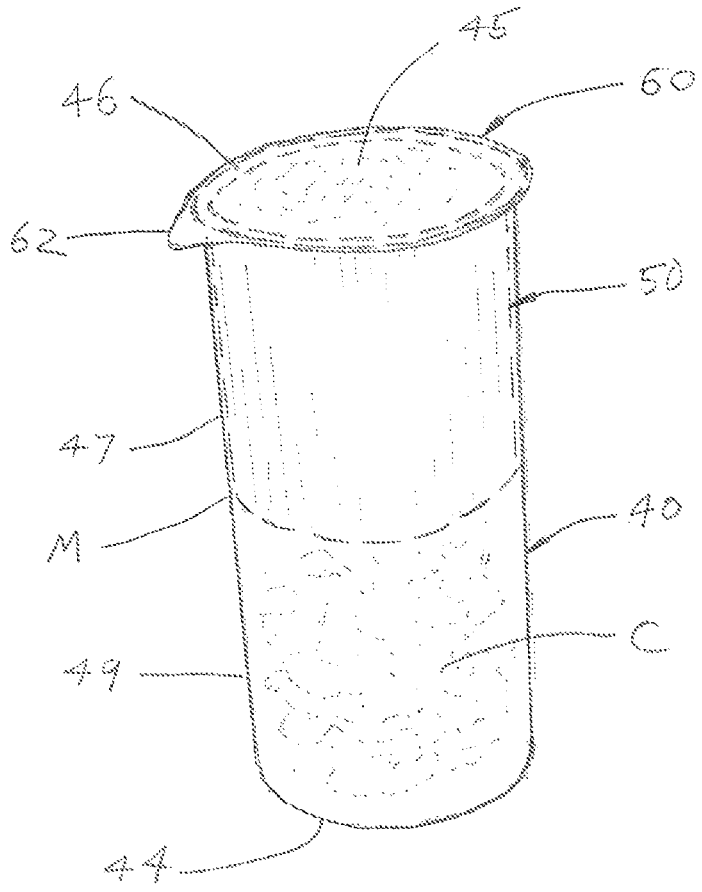
FIG. 3 is a perspective view of a pre-filled liner used in the preferred embodiment.

In FIG. 3 liner 40 has inversion tube 50 inserted inside and is filled with fluid contents C (dotted wavy lines). Liner 40 has an upper region 47, which is essentially 50% of its overall height, and a lower region 49, which is the other 50% of its overall height. As previously described, liner 40 is slightly tapered with its larger open end 45 being slightly larger than its closed end 44. This taper has three purposes: First, it allows the liners to be manufactured and nested to lower shipping costs; second, it makes it easy to handle when inserting the liner in the filling line, and; three, it allows inversion tube 50, which is also tapered, to fit snugly inside upper region 47. The unique combination of these two components represents a significant reduction in the trash stream compared to discarding entire bottles.

Figure 4:
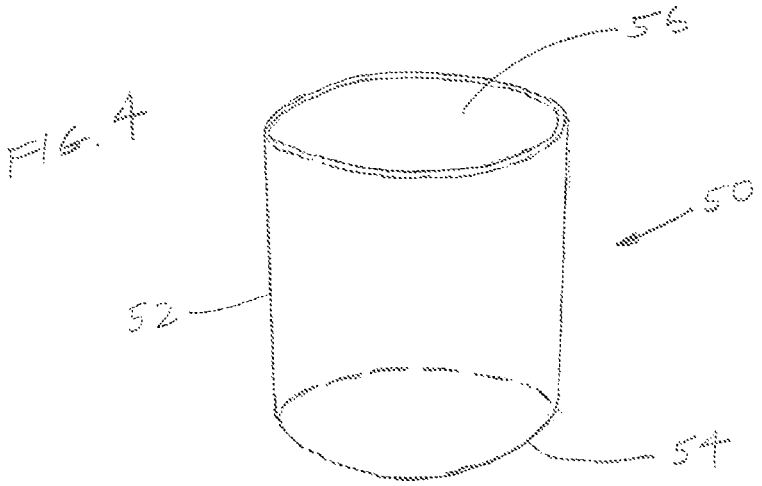
FIG. 4 is a perspective view the inversion tube used in the preferred embodiment.
Figure 5:
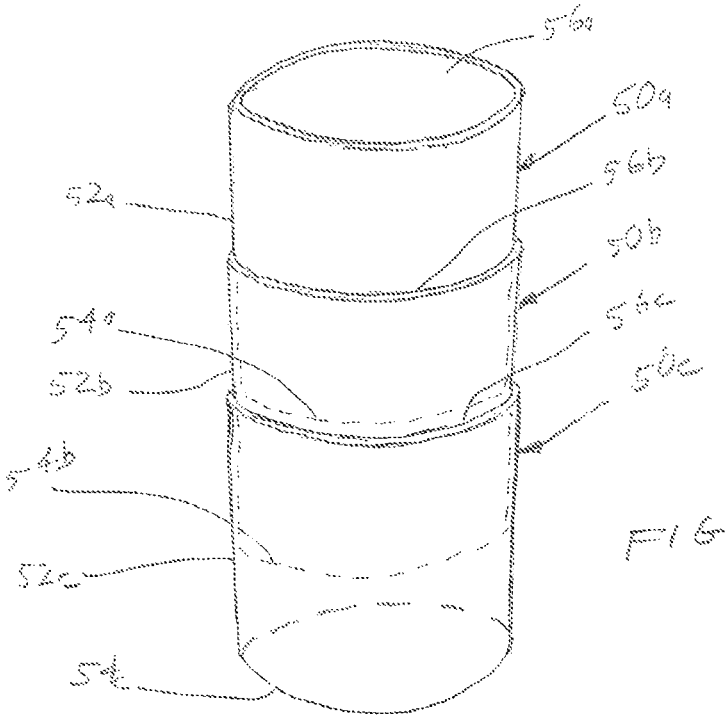
FIG. 5 is a perspective view the inversion tube used in the preferred embodiment when nested.

As shown in FIG. 3, inversion tube 50 is approximately one-half the height of liner 40 and is snugly fit inside upper region 47. In fact, the taper on inversion tube 50 (as illustrated in FIG. 4) is such that the outer diameter (OD) of the inversion tube provides a smooth transition throughout the length of the inversion tube body 52 and is essentially identical to the corresponding inner diameter of liner 40 at liner 40's upper region 47. As further shown in FIGS. 3-6, the opposing outermost open ends 54, 56 of the liner 50 have an outer diameter (OD) that is flush with the outermost diameter of the corresponding adjacent regions of the liner body 52. This smooth outside diameter of the liner body 52 along with the flush outermost ends 54, 56 ensures a snug fit (force fit) and makes insertion on the filling line a fast, simple process eliminating registration, gluing, heat sealing, bonding or the like. In other words, as shown in FIGS. 3-6, the inversion tube 50 has a smooth exterior surface contour or outside diameter. This smooth outer contour construction allows the inversion tube 50 to be easily inserted into the liner 40 and be completely nested therein. Such construction also allows the inversion tubes to be nested together in a stacked configuration as well as shown in FIG. 5. The closely matching inside diameter of the liner 40 and outside diameter of the inversion tube 50 further ensure the snug fit. While the outside diameter of either open end 52, 54 of the inversion tube 50 is flush with the outside diameter of an adjacent region of the tube body 52, if the inversion tube is tapered, then the outside diameters of the opposing ends 52, 54 would clearly not be the same. It is commonly understood that any extra steps required in a production line add additional variables, slows down productivity and output, and tends to increase defects. The close tolerances required to force fit inversion tube 50 inside liner 40 are reasonable in today's manufacturing environment. Likewise, since inversion tube 50 is a more rigid material than liner 40, which is a pliable, more flexible, and generally thinner film. This combination makes the insertion process highly efficient and effective. Liner 40 may be made by thermoforming, injection molding, blow molding, form, fill and seal (FFS), or may be fabricated from sheeting, which would require a seam (typically welded or bonded) along one more sides. The type of process to manufacture liner 40 is not restricted to a specific type as long as it provides the desired outcome. Nor is the combination of applying or attaching, the inversion tube, which likewise may be done in a multitude of ways.

Figure 9:
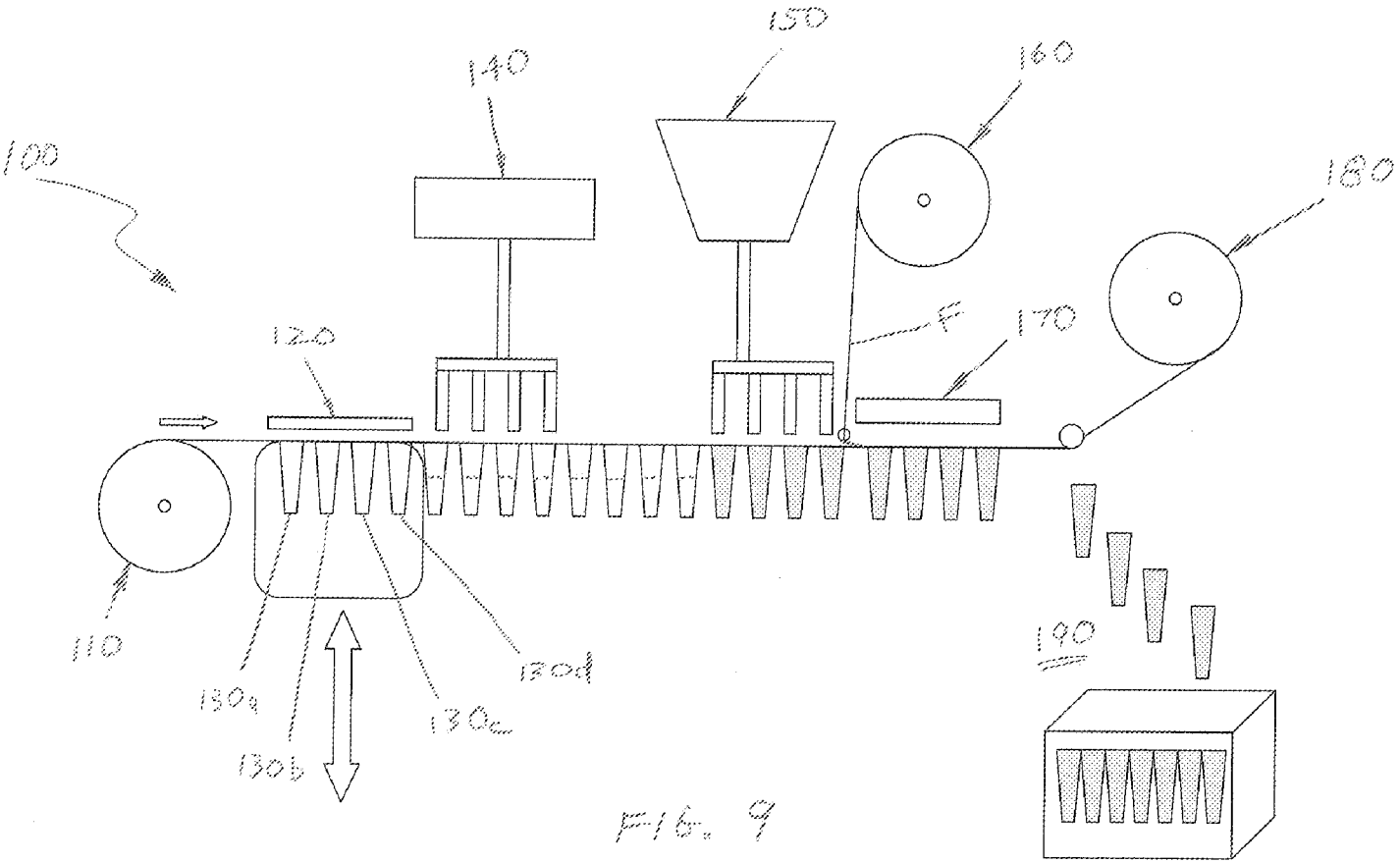
FIG. 9 is a diagram illustrating the filling process used with the preferred embodiment.

Once liner 40 has had inversion tube 50 inserted, it is filled with contents C and then top open end 45 is sealed with a lid 60. As illustrated lid 60 is sealed to liner flange 46 in a similar manner as a foil lid is used to seal the tops of yogurt containers. The process of attaching lid 60 such as that shown in FIG. 3 using lid film 160 is illustrated in FIG. 9. Prior to insertion of liner 40 into bottle 20, as illustrated in FIGS. 1 and 2, lid 60 is removed by pulling on tab 62, cap 30 is then screwed onto bottle 20, which tightens down onto flange 46 and liner 40 is secured to bottle 20. Lid 60 may be any number of configurations or types. Its purpose is to seal off the contents in the liner after filling so it may then be packaged and shipped to the end user. As illustrated, the lid is an inexpensive sealed lid, preferably a thin plastic film that can be quickly discarded. However, it may be a screw on type of lid, a plug that is inserted, a cap that punctures the lid on the liner when the cap is screwed down or secured to the bottle, and so on. This puncturable lid may also include an additional removable "protective cover" that serves as a dust protector and maintains a clean surface on puncturable lid itself.

In FIGS. 4 and 5 inversion tube 50, which is about one-half the overall length of liner 40, is shown in an upside down configuration with it open top end 54 below body 52 and it open bottom end 56 on the top. Top end 54 has a diameter slightly less than that of bottom end 56 so the multiple inversion tubes may be nested as illustrated in FIG. 5 with inversions tubes 50*a*, 50*b* and 50*c* and their bodies 52*a*, 52*b*, and 52*c* respectively, open top end 54*a*, 54*b*, and 54*c* respectively, and their open bottom ends 56*a*, 56*b* and 56*c* respectively. It goes without saying that these tubes may be nested in quantities much larger than three, and in the actual filling process may be into the hundreds. The only reason for illustrating inversion tube 50 in an upside down disposition is to show the natural nesting effect, plus a typical filling operation will be extracting the inversion tubes in essentially this same disposition. Extracting the tubes as such allows them to be inserted in a normal downward operation inside liner 40 as illustrated in FIG. 9.

While nesting is the preferred manner in which to ship and handle inversion tubes of the preferred embodiment, it is not essential. They may be shipped and handled in bulk form or may be in some form of internal manufacturing process where they are made in the same plant as the filling operation. Likewise the amount of taper depends on several factors including the length of the tube, and/or the degree of desirable taper to take advantage of space savings with deeper nesting. It also depends on the thickness of the outer wall. Generally speaking, in most sauce related applications such as ketchup and mustard, the thickness would be about 0.012 to 0.0020 depending on the type of material used. What is of most importance and is completely unlike all prior art sleeves, is that inversion tube 50 has a unique characteristic of being rigid, to induce inversion of liner 40 inside inversion tube 50, and likewise have the flexibility to be squeezed in a natural dispensing operation, both of which is described in detail in FIGS. 7*a* and 7*b*. We have found that a variety of FDA approved resins may be used to produce the desirable rigidity effects for an inversion tube used in a typical dispenser of the preferred embodiment that is about 8" tall and suitable for dispensing ketchup and mustard. Other materials may be used as long as they provide the desired outcome of having rigidity and flexibility as described herein.

Figure 6:
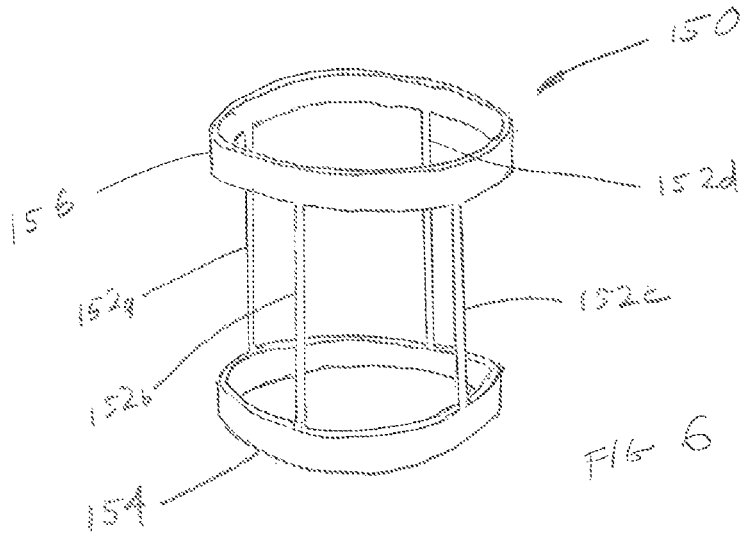
FIG. 6 is a perspective view of a variation of the inversion tube that may be used in the preferred embodiment.

The inversion tube illustrated in FIGS. 4 and 5 have a solid body, which is best used for food applications. It substantially eliminates the possibility of breakage of small parts, which parts may find their way into the food contents. In FIG. 6 is a variation that of an inversion tube that may be appropriate for certain applications where the potential for breakage and contamination of the contents is not as critical. In FIG. 6 inversion tube 150 has four upright members 152*a*, 152*b*, 152*c*, and 152*d*, a smaller diameter top ring 154 and a larger diameter bottom ring 156. This inversion tube performs essentially the same function as inversion tube 50 previous described in FIGS. 4 and 5 but may use less raw material. This may be more suitable for lighter fluids and liquids such as various types of waters and chemicals. All other aspects of insertion into a liner, the required taper, the ability to nest, handle, squeeze, and so on, are essentially the same as described with the inversion tubes in FIGS. 4 and 5.

The unique versatility and simplicity of the preferred embodiment in the perspectives as illustrated in FIGS. 1-6, by using different types of liners, inversion tubes, bottles, lids, valves and so on, allows for a multitude of uses, including many outside the realm of sauces and food products. With this versatility, it may be used for industrial uses such as glue, caulking, cleaners, or any other type of chemical imaginable.

B. Method of Use

Figure 7A:
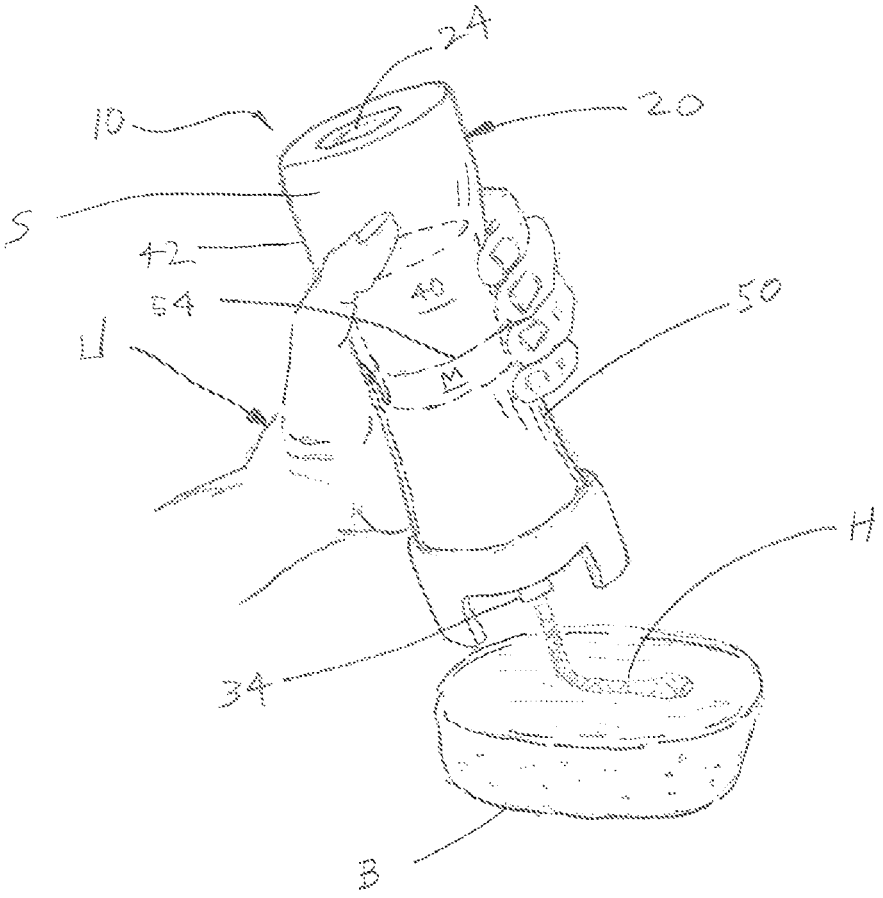
FIG. 7*a* is a perspective view the dispenser system illustrated in FIGS. 1 and 2 when placed in use.
Figure 8:
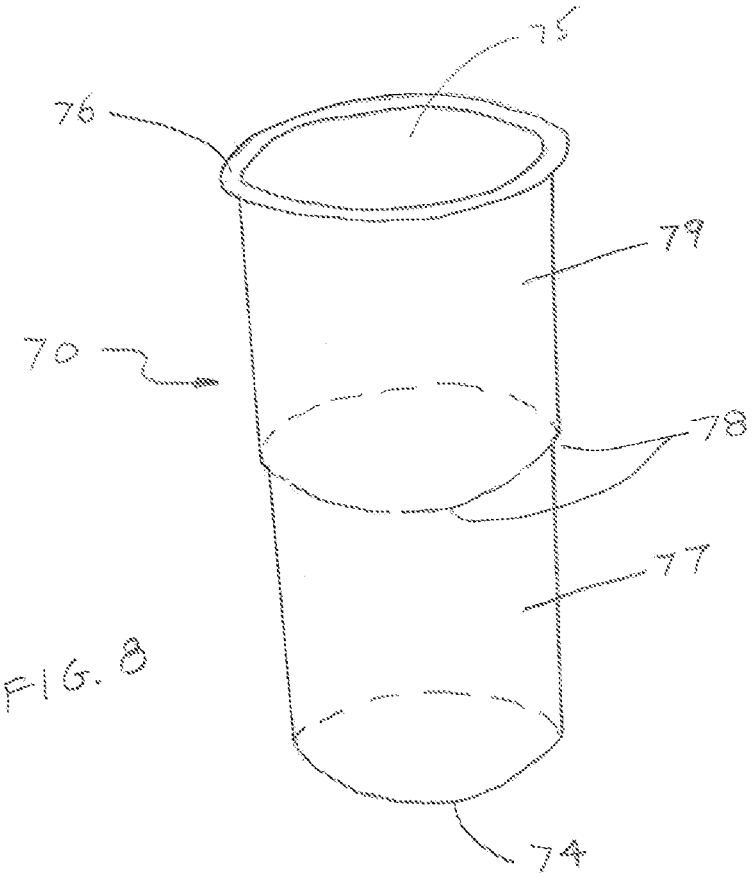
FIG. 8 is a perspective view of a variation of the preferred embodiment, a one-piece liner that requires no inversion tube.

In FIG. 7A user U has grasped bottle 20 of dispenser 10 about its midsection and has squeezed bottle 20 forcing sauce H to evacuate out through duckbill valve 34. Upon release of the user's squeeze, the internal pressure ceases and dispensing (or evacuation) of sauce H also ceases. Air then enters through umbrella valve 24, thus literally replacing the voided sauce and neutralizing the pressure in space S between liner 40 and the inside of bottle body 42. This simple dispensing operation incorporates the same natural tendencies of users in the food service industry. Unlike all prior art dispensers described herein, the user is free to grasp the bottle in the mid-section as illustrated or the mid-lower section, since inversion tube 50 is sufficiently flexible to allow it to be squeezed.

In FIG. 7*a*, liner 40 is illustrated as being "already partially dispensed, perhaps about 20% of sauce H already has been evacuated. As shown at midway point M on bottle 20, liner 40 has begun its inversion into the open top end 54 of inversion tube 50. The more sauce that is dispensed, the further liner 40 inverts itself inside inversion tube 50, until it is completely evacuated as is illustrated in FIG. 7*b*.

Figure 7B:
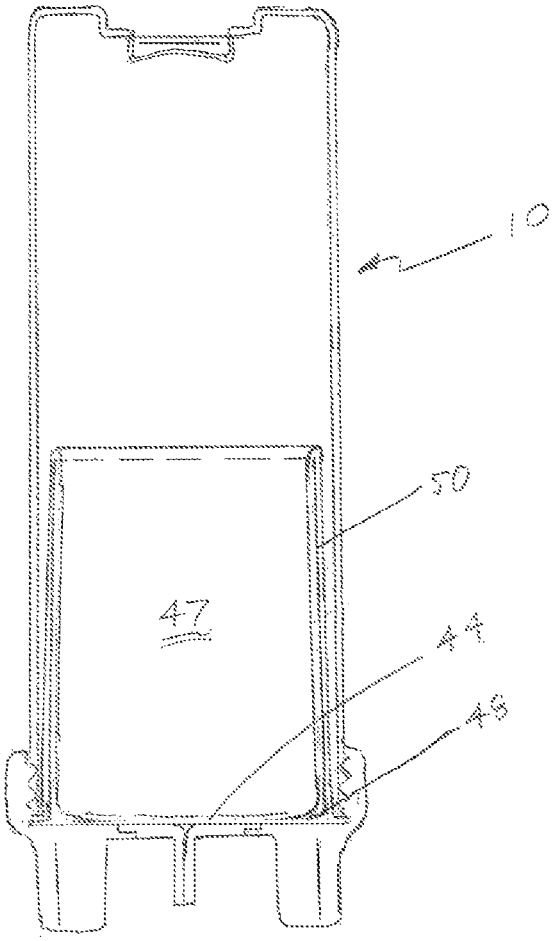
FIG. 7*b* is a perspective view the dispenser system illustrated in FIGS. 1 and 2 with substantially all of its contents having been dispensed.

In FIG. 7*b* sauce H has been completely dispensed from dispenser 10 with the upper region 47 of liner 40 completely inverted inside inversion tube 50. As previously discussed, the smooth, even inversion of liner 40 into inversion tube 50 eliminates creases and cavities that may trap sauce during the dispensing process. The small amount of fugitive sauce that may not have been dispensed would be confined to the small gaps at the outer edges 48 of closed end 44. This miniscule amount left un-dispensed by the preferred embodiment is insignificant compared to existing prior art bottles presently used. The dispenser is now ready for a new liner and continued dispensing.

In FIG. 8 one-piece liner 70 performs essentially the same as the combination of liner 40 and inversion tube 50 as illustrated herein except that it is one single piece of material. One piece liner 70 has an upper portion 77 (as when it is in its inverted disposition), which is essentially 50% of its overall height, and a lower portion 79 (as when it is in its inverted disposition, which is the other 50% of its overall height. Lower portion 79 is larger in diameter than upper portion 77 and likewise is substantially thicker, and serves the exact same purpose as inversion tube 50. The added thickness of lower portion 79 provides for the rigidity required for the preferred embodiment to function properly and for the liner to invert inside itself. An example of thicknesses would be manufacturing upper portion 77 with a thickness of 0.004" and lower portion 79 having a thickness of 0.020". Upon dispensing in a dispenser bottle as previously illustrated in FIGS. 7*a* and 7*b*, thinner upper portion 77 inverts effectively inside the thicker, more rigid, lower portion 79 in essentially the same manner as illustrated in FIGS. 7*a* and 7*b* (where upper region 47 inverts inside inversion tube 50).

One-piece liner 70 may or may not be slightly tapered with its larger open end 75 being slightly larger than its closed end 74. The purpose of the taper is essentially the same as previous described in that it would provide lower shipping costs (if manufactured outside the filling facility) and is easier to handle in the filling process. The obvious other benefit of the taper of one piece liner 70 is that it promotes inversion with the narrow upper portion 77 inverting itself into thicker lower portion 79. In the illustration in FIG. 8 the upper portion 77 is "stepped down" at a midway point 78 where the two portions 77 and 79 meet, to illustrate an example of a means to promote initiation of the inversion process. Other means may be used to initiate inversion as well such as a pre-creased line, a molded-in hinge, and so on.

One-piece liner 70 (empty as illustrated) may be filled in essentially the same manner as liner 40 illustrated in FIG. 3 with a lid (not shown) being sealed onto flange 76. Having a one piece liner requires a single step to be inserted into filling process as described in FIG. 9, or may be made inline in the thermoforming process itself. There are other variables with one piece liner 70 that may affect performance and economics that are of note. For example, the thicknesses of the upper portion 77 and lower portion 79 may be significantly less with certain types of plastic materials and manufacturing processes. They may be as thin as 0.002" for upper portion 77 and as thin as 0.006" for lower portion 79. Rigidity of lower portion 79 may also be enhanced with ribbing, accordion folds, the use of dissimilar plastics (such as a stiffer one in the lower portion and more flexible one in the upper portion) and the like. In addition the manufacturing processes may include thermoforming, injection molding, in-mold labeling and so on. With in-mold labeling the liner would have a wraparound label that would be integral part of the lower portion 79 thereby providing the desired rigidity. The label may be plastic, paper, or any other suitable material.

C. Method of Filling

The inline thermoform, fill and seal (TFS) process 100 in FIG. 9 begins with liner film 110 being advanced under thermoforming dies 120 and forming liners 130*a*, 130*b*, 130*c* and 130*d*, which are then advanced under inversion tube inserter 140. After inserting inversion tubes in liners 130*a*, 130*b*, 130*c* and 130*d* (inserted inverter tubes illustrated by the dotted line at the midway points on the unfilled liners) the liners are advanced to contents filler 150 and filled to the top (illustrated by liners in grayscale). Immediately following filling by contents filler 150, lid film 160 is unrolled with film F being positioned directly on top of the filled liners and fed under lid sealer/die cutter 170, and then wound up on scrap winder 180. As illustrated liners are then advanced to a packaging station 190, where they are boxed, palletized and eventually shipped to customers. The inline TFS system has many advantages in that it can be adapted, or reconfigured as the case may be, from existing filling systems. The two primary modifications to existing systems would be the thermoforming die system 120 and the inversion tube inserter 140.

The TFS system may also be effectively employed by using a liner inserter (not illustrated) using preformed liners instead of using liner film 110 and thermoforming dies 120. Likewise, a one-piece liner as illustrated in FIG. 8 may be used with a liner inserter in place of liner film 110, thermoforming dies 120, and inverter tube inserter 140. Other variations during a cycle may include the number of liners that are formed, the number of inversion tubes inserted, the method and number of liners being filled, the number of liners being sealed, and so on. Broad flexibility may be applied based on the contents being filled and the required volume. In addition, the forming of the liners may be efficaciously accomplished with a form, fill and seal process instead of thermoforming. This includes forming, filling and sealing (or lidding) multiple liners in a single operation and processing and handling same throughout the filling process. The manner of manufacturing or forming the liners (one-piece or when used with an inversion tube) is not a restriction on the filling process described herein. Likewise, the step of applying a label (for example, in mold labeling as described in FIG. 8 may be substituted in place of an insertion tube to provide the desired rigidity of the lower portion.

D. Variations

The spirit of the preferred embodiment provides a breadth of scope that includes all methods of making and using it and the processes of dispensing and filling. Any variation on the theme and methodology of accomplishing the same that are not described herein would be considered under the scope of the preferred embodiment.

What is claimed is:

1. A method of dispensing flowable contents from a dispenser comprising:

providing a dispenser bottle body with an elongated sidewall having an open end with a surrounding edge and a squeeze region projecting from proximate a mid-point of the bottle body to proximate the surrounding edge, the bottle body further including a first valve;

providing a disposable cartridge having a flexible inversion tube with a tube body having opposing sidewalls and a first outermost open end having a first outside diameter flush with an outside diameter of an adjacent region of the tube body and a second opposing outermost open end having a second outside diameter flush with an outside diameter of an adjacent region of the tube body having outermost ends with flush outer diameters, the inversion tube being slidably inserted into and nested completely within an invertible liner in close tolerance therewith with the liner including an outwardly extending flange, the liner being less rigid than the inversion tube;

pre-filling the disposable cartridge with a volume of flowable contents prior to insertion into the bottle body;

sealing off the volume of flowable contents within the disposable cartridge prior to insertion into the bottle body;

orienting the disposable cartridge with the flange of the liner removably seated on the surrounding edge of the bottle body to suspend the inversion tube within the squeeze region;

releasably securing a dispensing cap with an outlet on the dispenser bottle to seal off the open end of the bottle body to form a cartridge refill chamber and capture the flange of the liner between the cap and bottle body;

unsealing the disposable cartridge prior to forcing out at least a portion of the flowable contents out through the outlet of the dispensing cap;

squeezing the bottle body in an inverted orientation within the squeeze region to at least partially squeeze the opposing sidewalls of the flexible inversion tube closer together and increase internal pressure and incrementally invert at least a portion of the liner into the inversion tube to force at least a portion of the flowable contents out through the outlet of the dispensing cap; and relaxing the squeezing force applied to the bottle body to allow air to enter inside the bottle body through the first valve to replace the forced-out flowable contents and neutralize the pressure in a space between the disposable cartridge and the bottle body.

2. The method of dispensing as set forth in claim 1 further comprising:

providing an inversion tube with a tube body thicker than the liner and having a hollow interior, the inversion tube being removably snug fit into the liner to form a liner and tube assembly with the tube body terminating in opposing ends disposed solely within the squeeze region when the disposable cartridge is removably seated on the bottle body.

3. The method of dispensing as set forth in claim 1 wherein:

the outlet on the dispensing cap is a one-way valve.

4. The method of dispensing as set forth in claim 1 further comprising:

inverting the liner into the inversion tube to disgorge a majority of the volume of flowable contents out of the disposable cartridge.

5. The method of dispensing as set forth in claim 1 wherein:

the dispenser bottle body comprises a bulk container or a metal drum.

6. The method of dispensing as set forth in claim 1 wherein:

the inversion tube includes a first outer end ring disposed proximate the mid-point of the squeeze region and a second outer end ring disposed proximate the surrounding edge of the bottle body and a plurality of spaced apart members extending therebetween.

7. The method of dispensing as set forth in claim 1 wherein:

the inversion tube is removably nested within the liner.

8. The method of dispensing as set forth in claim 1 further comprising:

tapering at least a portion of the liner; and tapering at least a portion of the inversion tube to complement the taper of the liner.

9. The method of dispensing as set forth in claim 1 further comprising:

removably suspending the inversion tube within the liner with the liner interposed between the bottle body and the inversion tube.

10. A method of dispensing flowable contents from a dispenser comprising:

providing a squeeze bottle body with a closed bottom end and an open top end with an uppermost edge and an elongated, compressible sidewall having an interior surface and an exterior surface between the ends, the interior of the bottle body defining a cartridge refill chamber and the exterior of the bottle body defining a squeeze region extending from the uppermost edge to a midpoint along the length of the sidewall of the squeeze bottle body;

providing a first one-way valve disposed in the bottle body and constructed to allow external air to enter the refill chamber when a squeezing force is removed from the bottle body within the squeeze region;

providing a disposable cartridge including a seamless, invertible liner with an elongated sidewall with an exterior surface and an interior surface, the liner being tapered inwardly from an open end with a flange removably seated on the uppermost edge of the bottle body to an opposing closed end, the cartridge further including a resilient, inversion tube having an outer surface and an inner surface and being thicker than the elongated sidewall of the liner, the inversion tube being similarly tapered to the liner and removably snug fit into and releasably suspended within the liner with a first portion of the liner concentrically encircling the outer surface of the inversion tube and a second portion of the liner extending from the inversion tube into a fully extended configuration, the inversion tube further having a tube body with a first outermost open end having a first outside diameter flush with an outside diameter of an adjacent region of the tube body and a second opposing outermost open end having a second outside diameter flush with an outside diameter of an adjacent region of the tube body, the tube body being concentrically encircled by the squeeze region, the tube body further being compressible along its entire length to yield inwardly from a first tubular configuration to a compressed configuration in response to a squeezing force applied to the exterior surface of the bottle body within the squeeze region to compress the interior surface of the bottle body against the exterior surface of the first portion of the liner encircling the outer surface of the inversion tube with the interior of the inversion tube receiving an inverted portion of the invertible liner and the inversion tube being sufficiently resilient to return to the first tubular configuration when the squeezing force is removed from the squeeze region while the liner remains at least partially inverted, the cartridge further including a volume of contents at least partially filling the liner and extending through the inversion tube and a puncturable or removable seal spanning the open end of the liner;

pre-filling the disposable cartridge with a volume of flowable contents prior to insertion into the squeeze bottle body;

sealing off the volume of flowable contents within the disposable cartridge prior to insertion into the squeeze bottle body;

providing a dispenser cap constructed to releasably cover the open end of the squeeze bottle body and removably capture the flange of the liner between the dispenser cap and the uppermost edge of the bottle body to fix the position of the liner relative to the length of the bottle body with the inversion tube disposed with both open ends within the squeeze region;

providing a second one-way valve disposed in the cap and operable to allow the contents of the pre-filled cartridge to be evacuated from the bottle body when a squeezing force is applied to the squeeze bottle body within the squeeze region;

releasably securing the dispensing cap on the dispenser bottle to seal off the open end of the bottle body to form a cartridge refill chamber and capture the flange of the liner between the cap and the squeeze bottle body;

unsealing the disposable cartridge prior to forcing out at least a portion of the flowable contents out through the outlet of the dispensing cap;

squeezing the squeeze bottle body within the squeeze region in an inverted orientation to increase internal pressure and incrementally invert at least a portion of the liner into the inversion tube to force at least a portion of the flowable contents out through the outlet of the dispensing cap; and relaxing the squeezing force applied to the squeeze bottle body to allow air to enter inside the bottle body through the first valve to replace the forced-out flowable contents and neutralize the pressure in a space between the disposable cartridge and the bottle body with the first and second one-way valves cooperating to maintain the liner within the refill chamber in a vacuum state as the squeeze bottle body is repeatedly squeezed within the squeeze region to invert the liner incrementally into the inversion tube and disgorge the contents of the cartridge out through the second one-way valve.

11. A method of assembling a dispenser and a pre-filled disposable cartridge into a state ready for dispensing flowable contents comprising:

providing a dispenser bottle body with an elongated sidewall having an open end with a surrounding edge and a squeeze region projecting from proximate a mid-point of the bottle body to proximate the surrounding edge, the bottle body further including a first valve;

providing a disposable cartridge having a flexible inversion tube with a tube body having a first outermost open end having a first outside diameter flush with an outside diameter of an adjacent region of the tube body and a second opposing outermost open end having a second outside diameter flush with an outside diameter of an adjacent region of the tube body, the inversion tube being slidably inserted into and nested completely within an invertible liner in close tolerance therewith with the liner including an outwardly extending flange, the liner being less rigid than the inversion tube;

pre-filling the disposable cartridge with the volume of flowable contents prior to insertion into the bottle body;

sealing off the volume of flowable contents within the refill cartridge prior to insertion into the bottle body;

removably seating the disposable cartridge with the flange of the liner on the surrounding edge of the bottle body to suspend the inversion tube within the squeeze region;

providing a dispensing cap with an outlet;

releasably securing the dispensing cap on the dispenser bottle to seal off the open end of the bottle body to form a cartridge refill chamber and capture the flange of the liner between the cap and bottle body; and unsealing the disposable cartridge prior to or while forcing out at least a portion of the flowable contents out through the outlet of the dispensing cap.

* * * * *